United States Patent [19]

Pernyeszi

[11] Patent Number: 4,893,063

[45] Date of Patent: Jan. 9, 1990

[54] APPARATUS FOR IMPROVING THE EFFICIENCY OF A LIGHTING ELEMENT

[76] Inventor: Joseph Pernyeszi, 844 Weston Rd., Scotts Valley, Calif. 95066

[21] Appl. No.: 106,736

[22] Filed: Oct. 6, 1987

[51] Int. Cl.[4] ..... H05B 37/02

[52] U.S. Cl. ..... 315/307; 315/200 R; 315/194; 315/199

[58] Field of Search ..... 315/307, 308, 311, 247, 315/200 R, 194, 199

[56] References Cited

U.S. PATENT DOCUMENTS

| | | | |
|---|---|---|---|
| 3,597,652 | 8/1971 | Gates, Jr. | 315/311 X |
| 3,821,601 | 6/1974 | Kappenhagen et al. | 315/311 |
| 3,869,631 | 3/1975 | Anderson et al. | 315/200 R |
| 3,963,956 | 6/1976 | Beining | 315/200 R |
| 4,156,166 | 5/1979 | Shapiro et al. | 315/307 X |
| 4,229,680 | 10/1980 | Berlin, Jr. | 315/200 R |
| 4,350,931 | 9/1982 | Niskin | 315/200 R |
| 4,435,671 | 3/1984 | Wouk | 315/200 R |
| 4,447,765 | 5/1984 | Cote | 315/311 |
| 4,461,973 | 7/1984 | Kaufman et al. | 315/200 R |
| 4,480,212 | 10/1984 | Monahan et al. | 315/200 R |
| 4,629,943 | 12/1986 | Ponce, Jr. | 315/200 R |
| 4,645,982 | 2/1987 | Takayanagi | 315/308 |

*Primary Examiner*—James J. Groody
*Assistant Examiner*—Mark R. Powell
*Attorney, Agent, or Firm*—Townsend and Townsend

[57] ABSTRACT

A voltage reduction unit for reducing the voltage supplied to a lighting element to a prescribed value and for maintaining the prescribed voltage across the lighting element independently of the current flowing through it. A lighting element is connected in series with a current switch, and the current switch is controlled by a voltage/current control unit which monitors the lighting element for changes and voltage and current characteristics. The voltage/current control unit comprises a differentiator circuit for detecting a slope of an AC voltage waveform and a comparator circuit for detecting a prescribed voltage on the waveform. The voltage/current control unit allows current to flow through the lighting element when both a first prescribed voltage and a prescribed voltage slope of the voltage waveform is detected, and it inhibits current flow through the lighting element when a second prescribed voltage is detected. A signaling circuit receives signals from the comparator circuit and the differentiator circuit, and it communicates switching signals to the current switch for rendering the current switch conductive when signals representing the prescribed voltage and slope of the voltage waveform occur. When the comparator detects the second prescribed voltage, it emits a second signal, and the signaling unit, in turn, communicates a signal for turning off the current switch.

20 Claims, 6 Drawing Sheets

APPARATUS FOR IMPROVING THE EFFICIENCY OF A LIGHTING ELEMENT

BACKGROUND OF THE INVENTION

This invention relates to lighting elements and, more particularly, to an apparatus for increasing the efficiency and prolonging the life of an incandescent lamp.

DESCRIPTION OF THE RELEVANT ART

The life expectancy of convention filament light bulbs is in the approximate range of 750–1200 hours. While this appears to be a long period of time, very often, as in the case of light bulbs that operate continuously, it is not. Thus, we are all faced with the problem of constantly replacing light bulbs. This is not only expensive, but it often causes a continuous series of problems, especially for establishments which use a large number of light bulbs.

One method of extending the operating life of an incandescent lamp is to reduce the effective voltage across the filament. This has been accomplished by connecting a rectifying diode in series with the filament so that only a alternate half cycles of the supply voltage are applied to the filament. This has the effect of reducing the time average of voltage to a fraction of that produced by the unrectified supply voltage.

One of the difficulties encountered in the use of a diode for extending lamp life is that the reduction of effective voltage, without a change in the filament design, results in a large decrease in filament temperature, and the light output of the lamp is substantially diminished. Operation at the reduced temperature also results in lower efficiency of the filament in terms of lumens per watt. In order to overcome this disadvantage, lamps have been constructed with special filaments having a weight greater than is normally used for the particular lamp under consideration. Although the special filament improves the efficiency of the lamp, as compared with lamps having an unmodified filament, the special lamps cost more and are not always readily available. Furthermore, as the lighting element operates, the temperature of the filament and fluctuations in the line voltage cause the voltage across and the current through the lighting element to change. Unfortunately, this causes the bulb to deviate from its point of maximum operation efficiency, and the cost of operating the bulb increases.

SUMMARY OF THE INVENTION

The present invention is directed to an apparatus for reducing the voltage supplied to a lighting element to a prescribed value and for maintaining the prescribed voltage across the lighting element independently of the current flowing through it. In this manner, the lamp operates at peak efficiency and the life expectancy of the lamp increases manyfold.

In one embodiment of a voltage reduction unit according to the present invention, the lighting element is connected in series with a current switch, and the current switch is controlled by a voltage/current control unit which monitors the lighting element for changes in voltage and current characteristics. The voltage reduction unit reduces the electrical service rms voltage to the operating voltage of the low voltage lamp and supplies this rms voltage to the lamp independently of the current consumption of the lamp. The voltage reduction unit also dynamically adjusts the initial rms voltage supplied to the lamp for preventing the temporary overload of the filament when the lamp is turned on, thus further extending the life expectancy of the lamp.

The voltage/current control unit comprises a differentiator circuit for detecting a slope of an AC voltage waveform and a comparator circuit for detecting a prescribed voltage on the waveform. The voltage/current control unit allows current flow through the lighting element when both a first prescribed voltage and a prescribed voltage slope of the voltage waveform is detected, and it inhibits current flow through the lighting element when a second prescribed voltage is detected. A signalling unit receives signals from the comparator circuit and the differentiator circuit, and it communicates switching signals to the current switch for rendering the current switch conductive when signals representing the prescribed voltage and slope of the voltage waveform occur. When the comparator detects the second prescribed voltage, it emits a second signal, and the signalling unit, in turn, communicates a signal for turning off the current switch.

DETAILED DESCRIPTION OF THE PREFERRED EMBODIMENTS

Figure 1:
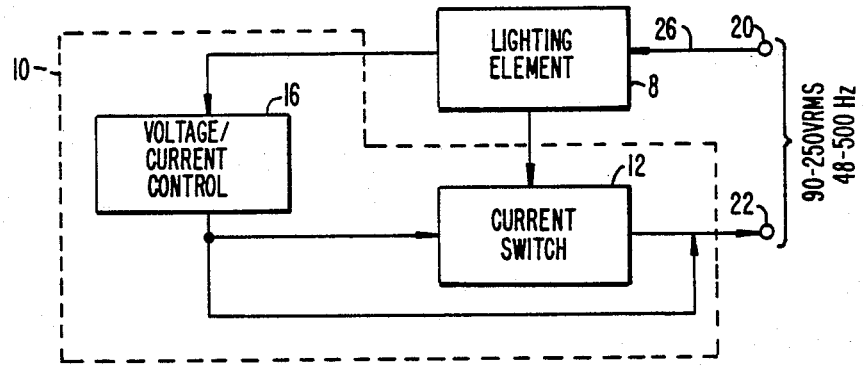
FIG. 1 is a block diagram of an embodiment of a high efficiency lighting system according to the present invention.

FIG. 1 is a block diagram of a high efficiency lighting system 4 comprising a lighting element 8 and a voltage reduction unit 10. Voltage reduction unit 10 comprises a current switch 12 for selectively allowing current to flow through lighting element 8, and a voltage/current control unit 16 for monitoring the voltage and current characteristics of lighting element 8 and for controlling the operation of current switch 12 in response thereto. Lighting element 8, current switch 12, and voltage/current control unit 16 are connected to electrical terminals 20 and 22 which, in this embodiment, may comprise a conventional household electrical socket supplying electrical power in the range of from approximately 110 volts rms to 240 volts rms and from approximately 48 Hz to 500 Hz. Lighting element 8 preferably comprises a conventional incandescent lamp, the RMS voltage rating of which is less than the RMS voltage supplied by electrical terminals 20 and 22, preferably 24 volts, for substantially increasing the life expectancy of the lamp without decreasing the amount of illumination from the lamp.

Current switch 12 preferably comprises a latching electrical switch, although non-latching devices may be used if desired. A latching type of electrical switch is better suited for AC applications. Well known examples of latching devices are the SCR (silicon controlled rectifier) and the TRIAC (bidirectional SCR). If an SCR is used as the current switch, then $$URMS^2 = \frac{U^2}{4\pi}\left(\pi - W + \frac{\sin - 2W}{2}\right)$$

where U=the peak value of the input voltage, W=the firing angle of the switch, and URMS=the desired output voltage. If a triac is used, then $$URMS^2 = \frac{U^2}{2\pi}\left(\pi - W + \frac{\sin - 2w}{2}\right) = 2URMS^2\ (SCR).$$

Thus, the output voltage is a function of the input voltage and the firing angle of the electrical switch. If the firing angle changes, URMS also will change. Thus, URMS may be held constant by changing the firing angle of the switch as the operating characteristics of the lighting element change.

Figure 2:
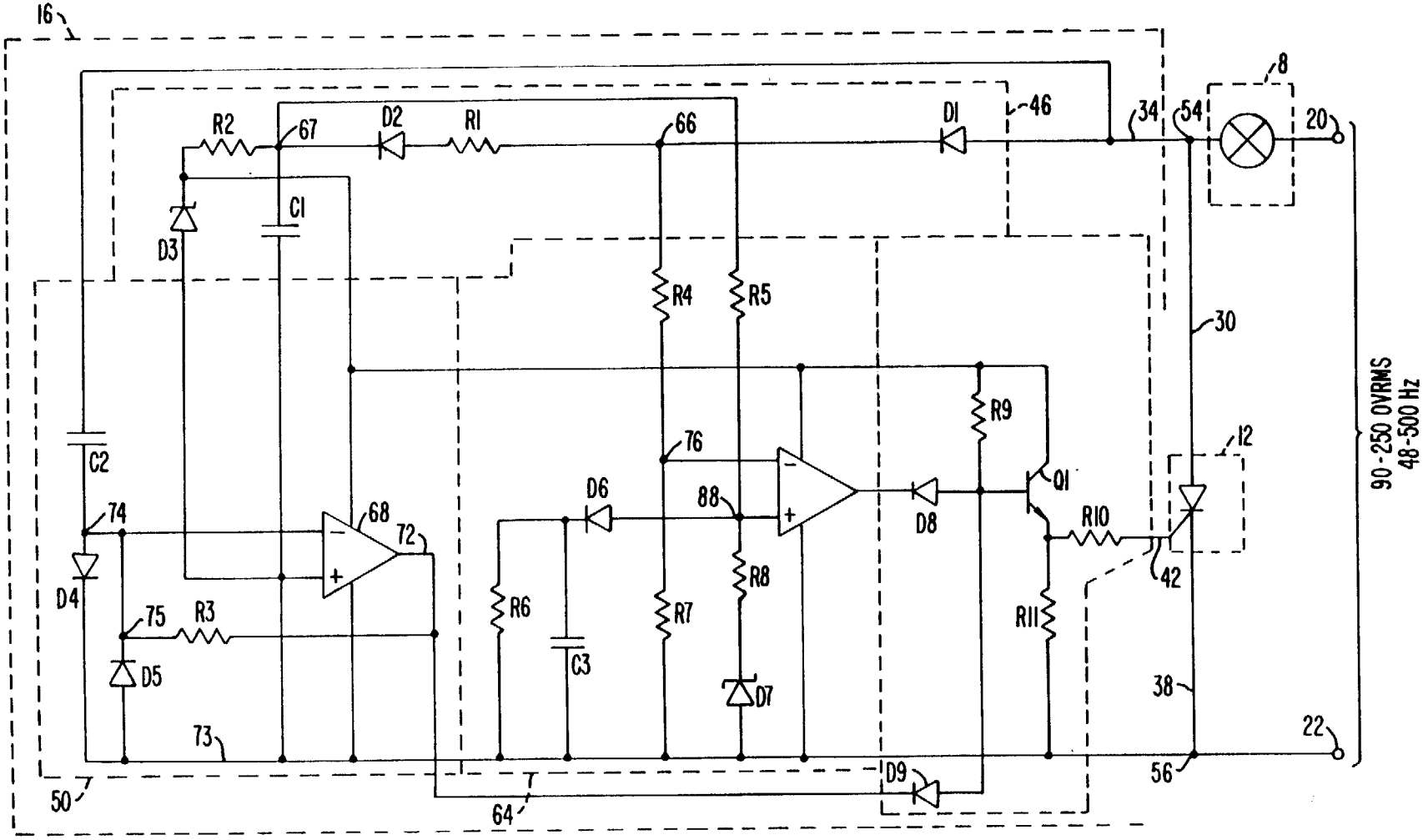
FIG. 2 is a schematic diagram of the voltage/current control unit of FIG. 1.

FIG. 2 is a schematic diagram of the high efficiency lighting system 4 illustrated in FIG. 1. As shown in FIG. 2, lighting element 8 preferably comprises a 24-volt incandescent bulb which receives voltage and current from terminal 20 over a line 26 and which communicates the voltage and current so received to current switch 12 over a line 30. The operating characteristics of lighting element 8 are communicated to voltage/current control unit 16 over a line 34. Current switch 12 comprises an SCR having its anode connected to line 30, its cathode connected to terminal 22 through a line 38, and its gate connected to voltage/current control unit 16 through a line 42.

Voltage/current control unit 16 comprises a power supply circuit 46 for providing power to the various sections of voltage/current control circuit 16, a differentiator circuit 50 for detecting the slope of the AC voltage waveform appearing at nodes 54 and 56, and a comparator circuit 60 for detecting a prescribed voltage appearing across nodes 54 and 56. A signalling circuit 64 is for detecting when a prescribed slope and voltage is detected by differentiator circuit 50 and comparator circuit 60 and for providing a switching signal on line 42 to current switch 12 for rendering current switch 12 conductive.

Power supply circuit 46 comprises a diode D1 having its anode connected to line 34, a resistor R1 connected to the cathode of diode D1, a diode D2 having its anode connected to resistor R1, a resistor R2, a capacitor C1 connected to the cathode of diode D2 and a zener diode D3 connected to resistor R2. Diode D1 rectifies the incoming AC voltage so that a half-wave rectified alternating current appears at a node 66 between diode D1 and resistor R1. C1 is the buffer capacitor in the rectifier, and its value is chosen so that a smooth DC voltage is supplied to differentiator circuit 50, comparator circuit 60, and signalling circuit 64. Diode D2 prevents current from flowing in the reverse direction from capacitor C1 to resistor R1 during the time that the voltage at node 54 is less than that across capacitor C1. Zener diode D3 stabilizes the voltage across. Diode D3 is rated at approximately 35 volts.

Differentiator circuit 50 comprises an op amp 68, a capacitor C2, a resistor R3, and diodes D4 and D5. Capacitor C2 is connected between line 34 and the anode of diode D4. Resistor R3 is connected between an output terminal 72 of op amp 68 and the cathode of diode D5. The cathode of diode D4 and the anode of diode D5 are connected to terminal 22 through a line 73. The negative terminal of op amp 68 is connected to a node 74 between diode D4 and capacitor C2 and to a node 75 between diode D5 and resistor R3. The positive terminal of op amp 68 is connected to, resistor R2, and the anode of zener diode D3. Op amp 68 emits a positive signal on output terminal 72 when the voltage waveform across nodes 54 and 56 has a negative slope. Likewise, op amp 68 emits a negative signal on output terminal 72 when the voltage waveform across nodes 54 and 56 has a positive slope. Diodes D4 and D5 provide protection to op amp 68 from voltage transients.

Comparator circuit 60 comprises an op amp 73, resistors R4 and R5, a capacitor C3, a diode D6, resistors R6, R7, and R8, and a zener diode D7. Resistors R4 and R7 are connected in series between node 66 and line 73. The negative terminal of op amp 73 is connected to a node 76 between resistor R4 and R7. Accordingly, resistors R4 and R7 form a voltage divider, and the voltage at node 76 is determined by the voltage across nodes 54 and 56 and the ratio of R4 to R7. Resistors R5 and R8 are connected in series between node 67 and the cathode of zener diode D7. The anode of zener diode D7 is connected to terminal 22 through line 73. The positive terminal of op amp 73 is connected to a node 88 between resistor R5 and R8. Resistors R5 and R8 provide bias for zener diode D7, and zener diode D7 stabilizes the voltage across itself at about 15 volts. Resistors R5 and R8 thus form a voltage divider between node 67 and the cathode of zener diode D7. The result is that a small DC voltage is added to the voltage across zener diode D7, and the added voltage appears at node 88 to form a reference voltage.

When current switch 12 is off, the voltage at node 76 is proportional to the AC input voltage for its positive half period. The small varying component of the voltage at node 88 functions to stabilize the voltage across lighting element 8. Op amp 72 compares the voltage at nodes 76 and 88. If the voltage at node 76 is more positive than the voltage at node 88, then a positive signal appears on output terminal 92 of op amp 73. Similarly, if the voltage at node 88 is more positive than the voltage at node 76, then a negative signal appears on output terminal 92.

Capacitor C3 is connected between capacitor C1 and the cathode of diode D6. The anode of diode D6 is connected to node 88. Resistor R6 is connected to terminal 22 through line 73 and to a node 94 between diode D6 and capacitor C3. When the lighting element is initially switched on, capacitor C3 charges through diode D6, and the changing current represents a load at terminal 88. As a consequence, the voltage at terminal 88 increases gradually, and hence the positive signal appearing on output terminal 92 of op amp 73 is delayed, which, in turn, delays the firing of current switch 12 and the turn on of lamp 8, as discussed more fully below. Accordingly, capacitor C3 prevents a high inrush of current through lighting element 8 upon initial turn-on. Diode D6 decouples capacitor C3 from node 88 during normal operation. When the circuit is turned off, resistor R6 allows capacitor C3 to discharge so that the circuit is ready for the next turn on. The value of R6 is chosen so that it is a negligible load for capacitor C3 during normal operation.

Signalling unit 64 is connected for receiving the signals appearing on output terminal 72 of op amp 68 and on output terminal 92 of op amp 73 and for providing a switching signal on line 42 for controlling the operation of current switch 12. Signalling circuit 64 comprises a transistor Q1, a resistor R9 connected between the base and the collector of transistor Q1, a diode D8 connected between output terminal 92 of op amp 73 and the base of transistor Q1, a diode D9 connected between output terminal 72 of op amp 68 and the base of transistor Q1, a resistor R10 connected between the emitter of transistor Q1 and line 42, and a resistor R11 connected between the emitter of transistor Q1 and line 73. Diodes D8 and D9 and resistor R9 allow the base of transistor Q1 to become positive when positive signals appear on both output terminals 72 and 92. On the other hand, a negative signal emitted from either differentiator circuit 50 or comparator circuit 60 causes current to be conducted away from the base of transistor Q1, thus turning Q1 off. Resistors R10 and R11 limit the current flowing through the emitter of transistor Q1. When transistor Q1 is turned on, sufficient current is supplied to line 42 for rendering current switch 12 conductive, and current switch 12, in turn, allows current to flow through lighting element 8.

Figure 3:
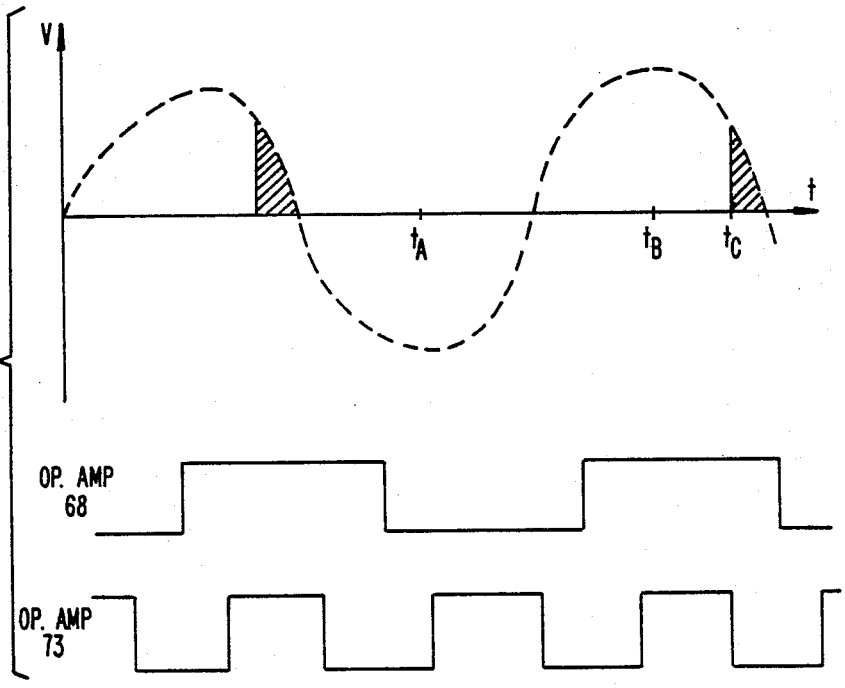
FIG. 3 is a diagram of an AC voltage waveform illustrating the operation of the embodiment of FIG. 1.

In operation, a voltage is applied to terminals 20 and 22 and is communicated to node 54 through lighting element 8 and to node 56. Differentiator circuit 50 emits a positive or negative signal on line 72 according to the slope of the voltage waveform appearing across nodes 54 and 56 as shown in FIG. 3. During time TA to TB, current switch 12 is prevented from turning on by the negative signal appearing at the output of differentiator circuit 50. At the same time, capacitor C3 of capacitor circuit 60 begins to charge and inhibits the rate of increase of voltage appearing at node 88. When diode D7 reaches its zener voltage and node 88 reaches the prescribed voltage, a positive signal appears on output terminal 92 of op amp 73. Consequently, when a negative slope is detected by differentiator circuit 50 and the prescribed voltage is detected by capacitor circuit 60, diodes D8 and D9 become reverse biased and current is allowed to flow to the base of transistor Q1, thus turning it on. Current flows from the collector to the emitter of transistor Q1, through resistor R10 and to line 42. The signal on line 42 is sufficient to render current switch 12 conductive, and current then flows through lighting element 8. When node 76 becomes more positive than node 88, a negative signal appears on output terminal 92 of op amp 73, diode D8 becomes forward biased, transistor Q1 turns off, current switch 12 turns off, and current is not allowed to flow through lighting element 8. As a result, current flows through lighting element 8 only during the time interval TC to TD.

As lighting element 8 heats up and the resistance of the filament varies, or if the voltage appearing at terminals 20 and 22 varies, the filament appearing at nodes 76 and 88 likewise will vary. The point at which comparator circuit 60 detects the prescribed waveform voltage will change accordingly to compensate for this voltage change so that current switch 12 conducts over greater or lesser intervals, thus maintaining the voltage across lighting element 8 constant. By shifting the firing angle as the operating characteristics of lighting element 8 change, the voltage across lighting element 8 will not deviate from 24 volts by more than 4 percent in the range of 100–240 volts. Consequently, lighting element 8 operates at its maximum efficiency and at a considerable savings to the user.

Figure 4:
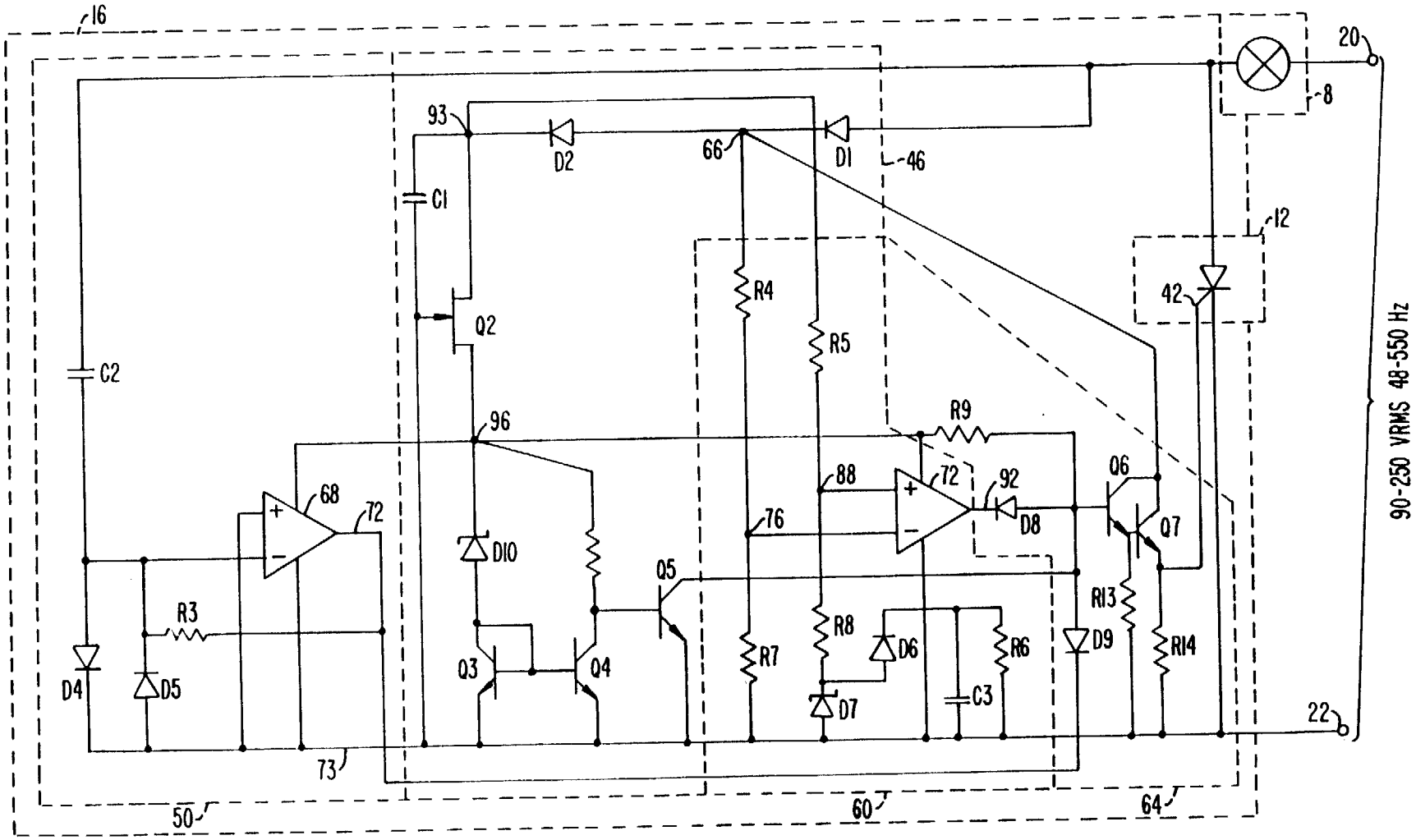
FIG. 4 is a schematic diagram of an alternative embodiment of the voltage/current control unit of FIG. 1.

While the above is complete description of a preferred embodiment of the present invention, various modifications may be employed. For example, power supply circuit 46, differentiator circuit 50, comparator circuit 60, and signalling circuit 64 may be redesigned to make them suitable for monolithic integrated circuit technology. Such a circuit is shown in FIG. 4. Power supply circuit 46, differentiator circuit 50, comparator circuit 60, and signalling circuit 64 of FIG. 4 are similar to the corresponding circuits in FIG. 2, and their operations are virtually identical. The only difference in structure occurs in power supply circuit 46 and signalling circuit 64.

In power supply circuit 46 of FIG. 4, Transistor Q2 is an N-channel JFET having a gate terminal connected to anode 94 between line 73 and capacitor C1, a source terminal connected to a node 93 between capacitor C1 and diode D2 and a drain terminal connected to the cathode of a zener diode D10 at a node 96. Zener diode D10 stabilizes the voltages powering op amp 68 and op amp 73. The voltage rating of diode D10 is approximately 35 volts. Transistor Q2 acts as a current source for providing a nearly constant current to diode D10, even when the input voltage to the circuit changes. Transistors Q3, Q4, Q5, and resistor R12 form a start-up circuit that disables current switch 12 until proper operating voltage is available for the op amps. This is necessary to prevent erroneous operation immediately after turn-on. The bases of transistors Q3 and Q4 and the collector of transistor Q3 are connected to the anode of diode D10. The emitters of transistors Q3 and Q4 are connected to terminal 22 through line 73. The base of transistor Q5 and the collector of transistor Q4 are connected to resistor R12 which, in turn, is connected to a node 96 between transistor Q2 and diode D10.

When the voltage at node 96 is smaller than the zener voltage of diode D10, transistors Q3 and Q4 are off and transistor Q5 is on because of the bias provided by resistor R12. Since transistor Q5 effectively grounds the base of transistor Q6, current switch 12 is disabled. When the voltage at node 96 is higher than the zener voltage of diode D10, current flows through diode D10 and transistor Q3. The voltage across diode D10 and transistor Q3 is stabilized at a diode drop above the zener voltage. The current is transistor Q3 is mirrored in transistor Q4 and transistor Q5 is turned off. Once transistor Q5 is off, the circuit operates normally and current switch 12 fires in accordance with signals received from differentiator circuit 50 and comparator circuit 60.

In signalling circuit 64, the base of transistor Q6 is connected to the anodes of diodes D8 and D9. The collector of transistor Q6 is connected to the collector of a transistor Q7 and to node 66. The base of transistor Q7 and the emitter of transistor Q6 are connected to a resistor R13 which, in turn, is connected to terminal 22 through line 73. The emitter of transistor Q7 is connected to line 42 and to resistor R14. Resistor R14, in turn, is connected to terminal 22 through line 73.

Operation of signalling circuit 64 is substantially the same as signalling circuit 64 in FIG. 2. A negative signal emitted by either differentiator circuit 50 or comparator circuit 60 is communicated by diode D8 or diode D9, respectively, to the base of transistor Q6, turning it off. When both differentiator circuit 50 and comparator circuit 60 emit a positive signal, a positive signal is applied to the base of transistor Q6. When a positive signal is applied to the base of transistor Q6, transistor Q6 turns on transistor Q7 for driving the gate of the SCR comprising current switch 12. Resistors R13 and R14 stabilize the operation of transistor Q6 and Q7 so that leakages of transistors Q6 and Q7 do not interfere with the triggering of current switch 12.

Figure 5:
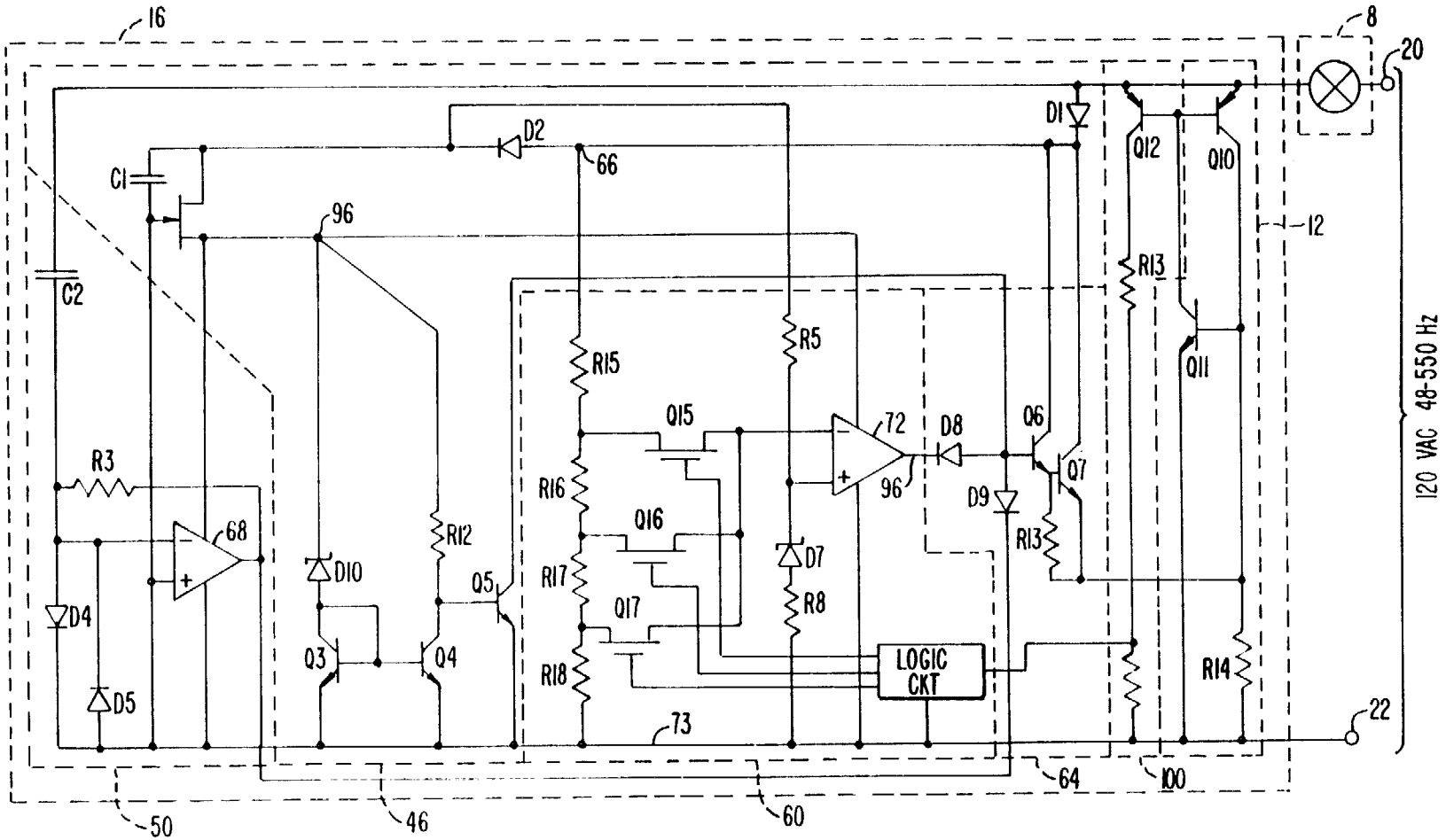
FIG. 5 is a schematic diagram of an alternative embodiment of the voltage/current control unit of FIG. 4.

In another embodiment of the present invention, illustrated in FIG. 5, the circuit is modified for providing substantially constant current through lighting element 8 at all times. Power supply circuit 46, differentiator circuit 50, and signaling circuit 64 of FIG. 5 are the same as the corresponding circuits in FIG. 4. Transistors Q10 and Q11 in current switch 12 are the transistor equivalent of an SCR. The only substantive difference in structure occurs in comparator circuit 60 and the addition of a current sensing circuit 100.

Comparator circuit 60 differs in that the negative terminal of op amp 73 is connected to a variable voltage divider network comprising resistors R15, R16, R17, R18, FET transistors Q15, Q16, and Q17, and logic circuit 102. Resistors R15, R16, R17, and R18 are connected in series between node 66 and line 73. The source terminals of transistors Q15, Q16, and Q17 are connected to nodes 110, 111, and 112, respectively, and the drain terminal of each transistor Q15, Q16, and Q17 is connected to the negative terminal of op amp 73. The gate of each transistor Q15, Q16, and Q17 is controlled by logic circuit 102. Logic circuit 102 receives signals from a node 118 between resistors R13 and R14 in current sensing circuit 100. Logic circuit 102 may comprise a programmable logic array, a suitably programmed microprocessor and, if necessary, suitable A-to-D converters for transforming the analog signals into a digital form usable by logic circuit 102 and visa versa.

In current sensing circuit 100, a transistor Q12 has its base connected for detecting current flowing through current switch 12. Transistor Q12 has its collector connected to the anode of diode D1 and its emitter connected to terminal 22 through resistors R13 and R14.

When power is first turned on, transistor Q15 is turned on by logic circuit 102 for connecting the highest node of the voltage divider to the negative terminal of op amp 73. When current switch 12 is triggered, the current flowing through it is sensed by transistor Q12 and logic circuit 102 compares the current flowing through transistor Q12 to a preset value. If the current exceeds the preset value, transistor Q15 remains on and transistors Q17 and Q16 remain off. If the current is less than the preset value, then logic circuit 102 turns transistor Q15 off and turns transistor Q16 on while maintaining transistor Q17 off. The decision making process is repeated for every pulse emitted by op AMP 68 in differentiator circuit 50. As the filament in the lamp warms up, its resistance increases and the current drawn by it drops. When the current drops below the preset value, the voltage divider tap is changed by logic circuit 102 to reduce the firing angle and thereby increase the RMS voltage to the lamp. This process provides the gradual increase of the RMS voltage to the lamp and results in a soft turn on.

In another embodiment, current switch 12 may be substituted with a triac and the circuit modified using the foregoing principles. In this embodiment, the triac conducts at a prescribed voltage, but includes both polarities of the voltage waveform.

Figure 6:
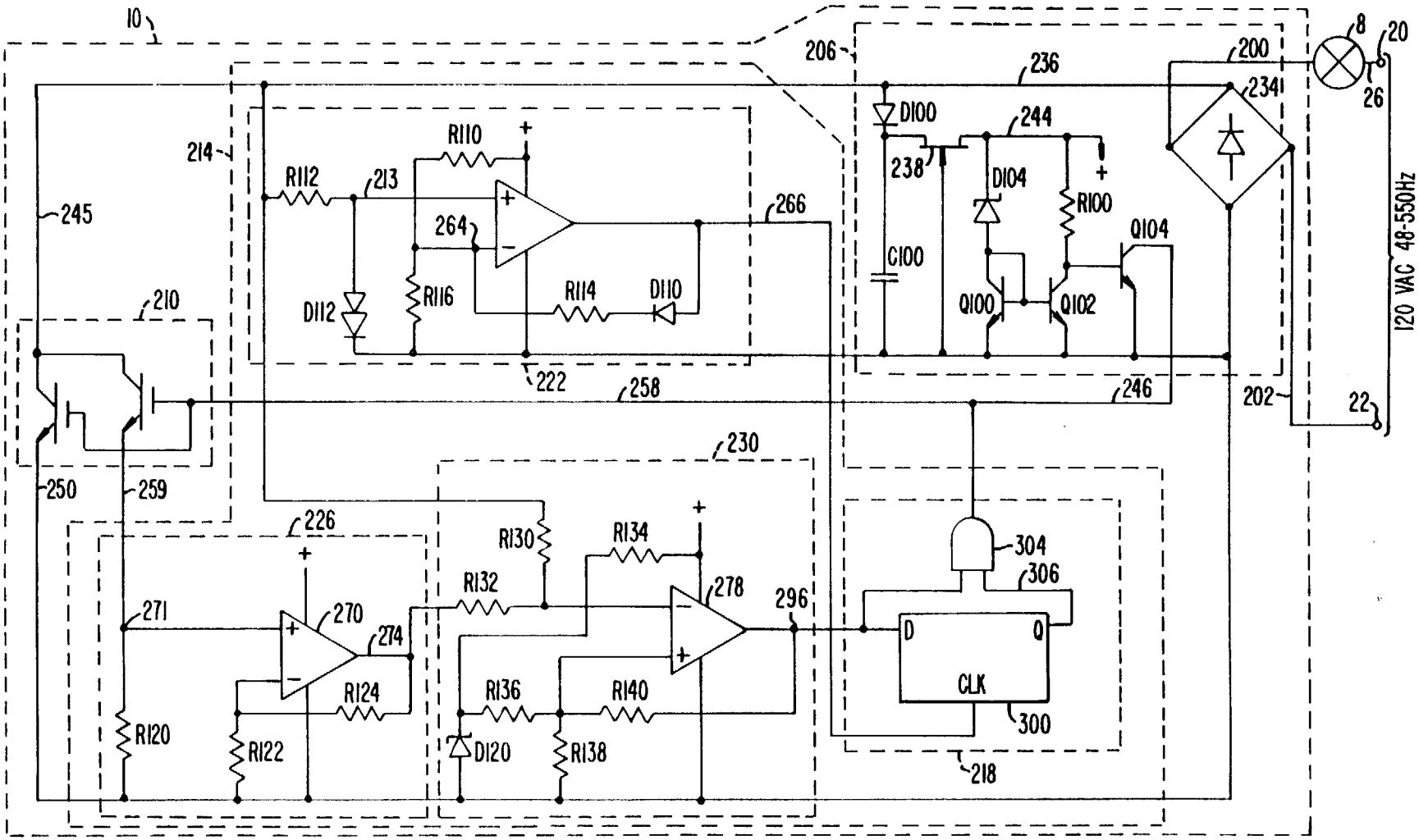
FIG. 6 is a schematic diagram of an alternative embodiment of a high efficiency lighting system according to the present invention.

FIG. 6 is a schematic diagram of another embodiment of the present invention. In this embodiment, the circuits are modified for providing a leading power factor, which is useful in establishments where lagging power factor frequently occurs (e.g., in machine shops where inductive motors cause current to lag voltage). As in the previous embodiments, lighting element 8 receives Ac voltage and current from terminal 20 over line 26 and communicates the voltage and current so received to voltage reduction unit 10 over line 200. Voltage reduction unit 10 in turn is connected to electrical terminal 22 through a line 202. Voltage reduction unit 10 selectively allows current to flow through lighting element 8 so that a phase of the current flowing through lighting element 8 leads a phase of the voltage applied to lighting element 8.

Voltage reduction unit 10 comprises a power supply circuit 206 for providing voltage and current to the circuit components. A current switch 210 allows a current to flow through lighting element 8 in response to a first signal and inhibits current flow through lighting element 8 in response to a second signal. A current switch control circuit 214 generates the first and second signals to current switch 210. Current switch control circuit 214 comprises a switch driver 218 for generating the actual first and second signals for current switch 210, a timing circuit 222 for detecting voltage across lighting element 8 and for timing the turn on of current switch 210, a current detector 226 for detecting current flowing through current switch 210 (and hence the bulb) and for providing signals in response thereto, and an amplifier circuit 230 for receiving the signals from current detector 226 and for providing switching data signals to switch driver 218.

Power supply circuit 206 comprises a diode bridge 234 connected to lines 200 and 202 for converting the AC current flowing through bulb 8 into DC current used by the components within voltage reduction unit 10. One side if diode bridge 234 is connected to the anode of a diode D100 through a line 236. The cathode of diode D100 is connected to one terminal of a capacitor C100 and to the source terminal of an N-channel JFET 238. The gate terminal of JFET 238 and the other terminal of capacitor C100 is connected to a line 242 which is connected to the other side of diode bridge 234. The drain terminal of JFET 238 is connected to a node 244 and to the cathode of a zener diode D104 and a resistor R100. Node 244 supplies a positive voltage to the op amps in the circuit. The anode of diode D104 is connected to the source terminal of a transistor Q100 and to the base of a transistor Q102. The other terminal of resistor R100 is connected to the collector terminal of transistor Q102 and to the base of transistor Q104. The emitters of transistors Q100, Q102 and Q104 are connected to line 242. The collector terminal of transistor Q104 is connected to current switch 210. Diode D100, capacitor C100, JFET 238, diode D104, resistor R100, and transistors Q100, Q102 and Q104 operate the same way as diode D2, capacitor C1, transistor Q2, zener diode D10, resistor R12, and transistors Q3, Q4 and Q5 of FIG. 4.

Current switch 210 comprises transistors Q110 and Q112. The collector terminals of transistors Q110 and Q112 are connected to line 236 through a line 245. The emitter terminal of transistor Q110 is connected to line 242 through a line 250. The emitter terminal of transistor Q112 is connected to current detector 226 through a line 254. The base terminals of transistors Q110 and Q112 are connected to line 246 from power supply 206 and to a line 258 from switch driver 218.

Timing circuit 222 comprises an op amp 262, resistors R110, R112, R114 and R116, and diodes D110 and D112. The noninverting input terminal of op amp 262 is connected to a node 263 between a terminal of resistor R112 and the anode of diode D112. The other terminal of resistor R112 is connected to line 245, and the cathode of diode D112 is connected to line 242. The inverting input terminal of op amp 262 is connected to a node 264 between serially connected resistors R110 and R116., Resistor R110 is further connected to node 244 in power supply 206, and resistor R116 is further connected to line 242. The output terminal of op amp 262 is connected to a line 266 which, in turn, is connected to the anode of diode D110 and to switch driver 218. The cathode of diode D110 is connected to resistor R114 which in turn in connected to the anode of diode D112 and to the noninverting input terminal of op amp 262. Op amp 262 senses the voltage on line 245 through node 263 and resistor R112, and it provides a negative signal when the voltage detected at node 263 is less than the trigger level set by resistors R110 and R116.

Current detector 226 comprises an op amp 270 and resistor R120, R122 and R124. The noninverting input terminal of op amp 270 is connected to a node 271 between the emitter of transistor Q112 and resistor R120. The other terminal of resistor R120 is connected to line 250. The inverting input terminal of op amp 270 is connected to a node 272 between serially connected resistors R122 and R124. The other terminal of resistor R122 is connected to line 250. The output terminal of op amp 270 is connected to a line 274 which in turn, is connected to the other terminal of resistor R124 and to amplifier circuit 230. Current detector 226 detects the voltage appearing on line 254, which is proportional to the current flowing from the emitter of transistor of Q12, and provides signals to amplifier circuit 230 over line 274.

Amplifier data circuit 230 receives the signals on line 274 from current detector 226 and provides switching data to switch driver 218. Current data circuit 230 comprises an op amp 278, resistors R130, R132, R134, R136, R138, R140 and zener diode D120. The inverting input terminal of op amp 278 is connected to a node 282 between resistors R130 and R132. The other terminal of resistor R130 is connected to line 245, and the other terminal of resistor R132 is connected to line 274 from current detector 226. The noninverting input terminal of op amp 278 is connected to a node 286 between resistor R136, R138 and R140. The other terminal of resistor R138 is connected to line 250. The other terminal of resistor R136 is connected to a node 290 between a terminal of resistor R134 and the cathode of zener diode D120. The anode of zener diode D120 is connected to line 250, and the other terminal of resistor R134 is connected to node 244 in power supply circuit 206. The output terminal of op amp 278 is connected to a line 296 which in turn is connected to switch driver 218.

Switch driver 218 receives the detected current, or switching data, signals from amplifier circuit 230 on line 296 and the timing signals from timing circuit 222 on line 266, and it provides switch control signals to switch 210 over line 258. Switch driver 218 comprises a D-type flip-flop 300 and an AND-gate 304. The D input terminal to flip-flop 300 is connected to line 296 and the clock input terminal of flip-flop 300 is connected to line 266. The Q output terminal of flip-flop 300 is connected to a line 306 which, in turn, is connected to an input terminal of AND-gate 304. The other input terminal to AND-gate 304 is connected to line 296. The output terminal of AND-gate 304 is connected to line 258.

Figure 7:
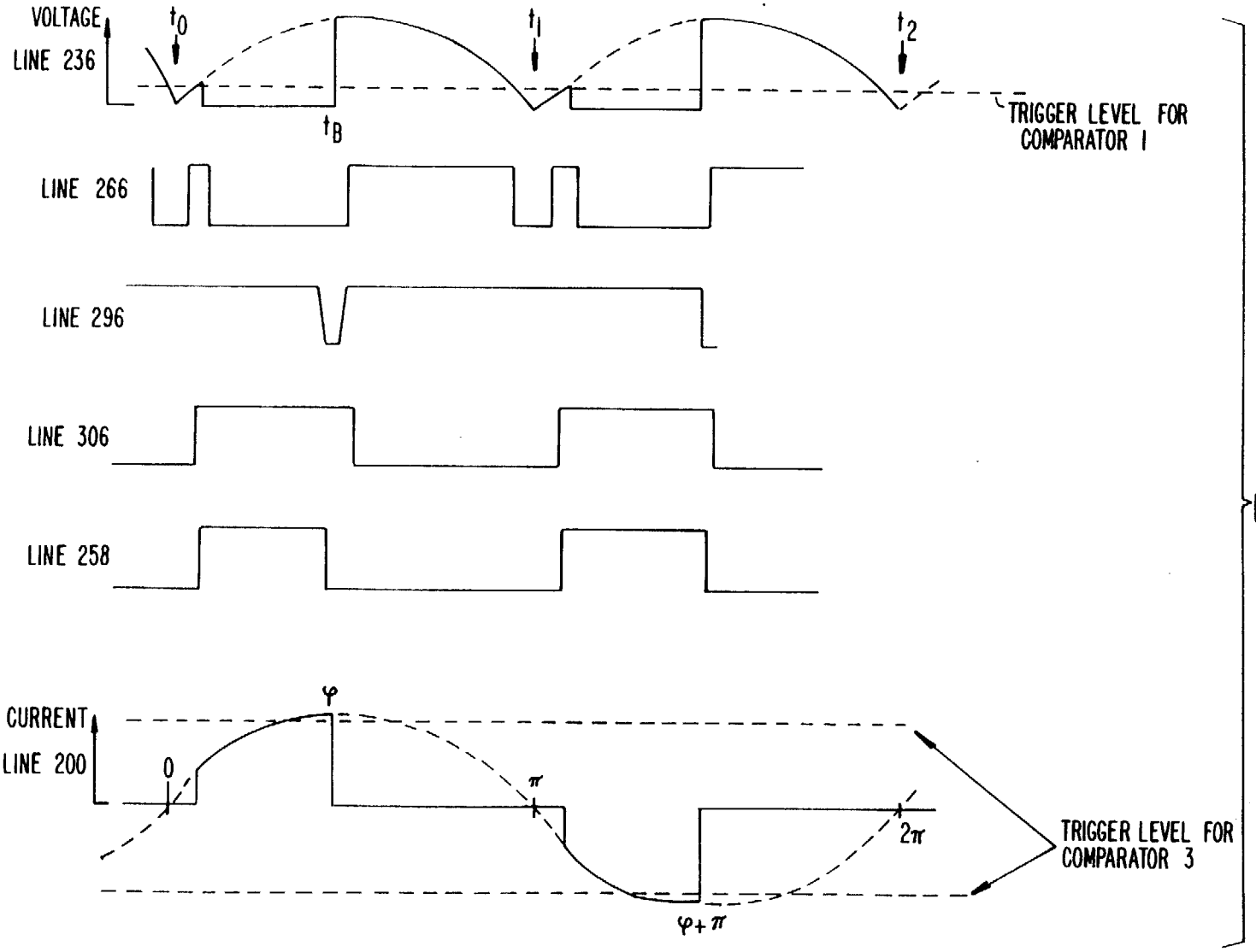
FIG. 7 is a timing diagram illustrating the operation of the embodiment of FIG. 6.

Operation of the circuit described in FIG. 6 may be understood by referring to FIG. 7. At time to, the voltage on line 245 is zero and thus the voltage at node 263 also is zero. Consequently, the signal on line 266 is at a logic low level. The voltages at node 271 and on line 274 are zero since there is no current flowing through current switch 210 and lighting element 8. Since the voltage at node 282 is less than that at node 286, the detected current signal on line 296 is at a high logic level. The initial signal on line 306 is a low logic level which also is the level whenever current flowing through current switch 210 exceeds the level set by current detector 226. Consequently, the output of AND-gate 304 is at a low logic level. This low logic level is communicated to the bases of transistors Q110 and Q112 in switch 210 through line 258. The low logic turns off current switch 210, and current flow through lighting element 8 is inhibited.

At time tA the voltage on line 245 rises until the voltage at node 263 exceeds the voltage at node 264. At this time, the output of op amp 262 and the signal on line 266, changes from a low logic level to a high logic level. This transition is communicated to the clock input terminal of flip-flop 300 which, in turn, causes the high logic level on line 296 to appear on line 306. The output of AND-gate 304 then changes from low to high, and the high signal appearing on line 258 turns on transistors Q110 and Q112. Current then flows through lighting element 8. When transistors Q110 and Q112 are conducting, the voltage on line 245 is near zero, well below the voltage at node 264. Therefore, the output of op amp 262 makes a transition to a low logic level.

As the system proceeds from time tA toward time tB, the current through the bulb increases and that causes the voltage at node 271 to increase. The voltage at node 271 is amplified by op amp 270, causing a resulting increase in the signal level at node 282. At time tB, the voltage at node 282 becomes more positive than the voltage of node 286. Consequently, the output of op amp 278 makes a transition to a low logic level, indicating that the maximum current has been detected. The low signal appearing on line 296 is communicated to AND-gate 304, and this causes the signal on line 258 to make a transition to a low logic level. Transistors Q110 and Q112 are turned off, and this in turn inhibits current flow through lighting element 8. When transistors Q110 and Q112 are off, line 245 will assume the momentary value of the AC voltage across terminals 20 and 22. The voltage at node 263 will become more positive than the voltage at node 264, causing the output of op amp 262 to make a transition to a high logic level. This transient causes flip-flop 300 to transfer the low logic level on line 296 to line 306 for maintaining transistors Q110 and Q112 in a nonconducting state. As the current through the bulb decreases, the voltage at node 271 and hence the voltage at node 282 also decreases. When the voltage at node 282 is less than that at node 286, the output of op amp 278 makes a transition to a high logic level which is used to turn on current switch 210 in the next cycle.

As the circuit progresses toward time t1, the voltage on line 245 eventually drops below the trigger level for op amp 262. This causes the signal on line 266 to change to a low logic level. At time T1 the cycle begins anew.

To prove that the circuit of FIG. 6 provides leading power factor, a fourier series may be generated from the waveform depicted in FIG. 7 for line 250. For simplification, it shall be assumed that current flow begins at points 0 and $\pi$ and ends at points $\phi$ and $\pi+\phi$.

For a given term $S_k$ in the series, $$S_k = \frac{1}{\pi} \int_0^{2\pi} f(\omega t)\, e^{-jk\omega t}\, d\omega t.$$

Referring to FIG. 7, $$f(\omega t) = I \sin \omega t \quad 0 \leqq \omega t \leqq \phi$$
$$\pi \leqq \omega t \leqq \phi + \pi$$
$$f(\omega t) = 0 \quad \phi \leqq \omega t \leqq \pi$$
$$\phi + \pi \leqq \omega t \leqq 2\pi$$

thus, for K=1 (the significant term in the series), $$S_1 = \frac{1}{\pi} \int_0^{\phi} I \sin(\omega t)\, e^{-j\omega t}\, d\omega t + \int_{\pi}^{\phi+\pi} I \sin \omega t\, d\omega t = \frac{I}{2\pi}(-2\phi j - \cos 2\phi + j \sin 2\phi + 1)$$

Now $$\psi = \arctan \frac{Im\, S_1}{Re\, S_1}$$

where $ImS_1$ denotes the imaginary part of $S_1$, and Re $S_1$ denotes the real part of $S_1$. Thus, $$\psi = \arctan \frac{\sin 2\psi - 1}{1 - \cos 2\phi}$$

For a 60 W lighting element and $\phi=0.587$ rad; $\psi=-1.473$ rad$=-84.43°$. For an ideal capacitor, $\psi=-90°$, so the present invention may be used in place of a bank of capacitors to offset the lagging power factor created by inductors coupled to the power distribution system.

In view of the foregoing, the scope of the invention should not be limited, except as set forth in the appended claims.

I claim:

1. Apparatus for regulating the illumination of a lighting element connected to an alternating current voltage supply comprising:

voltage detecting means for detecting the AC voltage across a lighting element; and voltage maintaining means, responsive to the voltage detecting means, for maintaining a prescribed voltage across the lighting element independently of the current flowing through the lighting element, the voltage maintaining means including initial voltage increasing means for gradually increasing the voltage across the lighting element when the lighting element is initially turned on.

2. Apparatus for regulating the illumination of a lighting element comprising:

means for receiving an alternating current waveform from a power source;

voltage detecting means, connected to the receiving means, for detecting a prescribed voltage point on the alternating current waveform;

voltage slope detecting means, connected to the receiving means, for detecting a slope of the alternating current waveform;

current switching means, connected to the voltage detecting means and to the lighting element, for allowing a current to flow through the lighting element when a first prescribed voltage point is detected and for inhibiting current flow through the lighting element when a second prescribed voltage point is detected; and wherein the current switching means allows a current to flow through the lighting element only when a prescribed waveform slope is detected.

3. The apparatus according to claim 2 wherein the voltage slope detecting means provides a signal indicating the slope of the alternating current waveform for a substantial portion of the alternating current waveform.

4. Apparatus for regulating the illumination of a lighting element comprising:

means for receiving an alternating current waveform from a power source;

voltage detecting means, connected to the receiving means, for detecting a prescribed voltage point on the alternating current waveform;

voltage slope detecting means, connected to the receiving means, for detecting a slope of the alternating current waveform, the voltage slope detecting means comprising a differentiator circuit which emits a first prescribed signal when the voltage waveform has a negative slope;

current switching means, connected to the voltage detecting means and to the lighting element, for allowing a current to flow through the lighting element when a first prescribed voltage point is detected and for inhibiting current flow through the lighting element when a second prescribed voltage point is detected; and wherein the current switching means allows a current to flow through the lighting element only when a prescribed waveform slope is detected.

5. The apparatus according to claim 4 wherein the voltage detecting means comprises a comparator circuit which emits a second prescribed signal when the voltage detected has a prescribed value relative to a reference voltage.

6. The apparatus according to claim 5 wherein the current switching means comprises a signalling means, connected to the differentiator circuit and to the comparator circuit, for emitting a switching signal when the first prescribed signal is emitted by the voltage slope detecting means and the second prescribed signal is emitted by the voltage detecting means.

7. The apparatus according to claim 6 wherein the current switching means further comprises current flowing means, connected to the signalling means and to the lighting element, for allowing current to flow through the lighting element when the switching signal is emitted by the signalling means.

8. The apparatus according to claim 7 wherein the signalling means comprises a transistor having a base connected for receiving signals from the differentiator circuit and from the comparator circuit, the transistor flowing a current from a collector to an emitter thereof when the first prescribed signal is emitted by the voltage slope detecting means and the second prescribed signal is emitted by the voltage detecting means.

9. The apparatus according to claim 8 wherein the current flowing means comprises a semiconductor controlled rectifier, connected to the lighting element and to the transistor, for flowing a current through the lighting element when current flows from the collector to the emitter of the transistor.

10. The apparatus according to claim 9 further comprising a capacitance connected to the comparator circuit for impending the rate of voltage increase to the comparator circuit when the alternating current waveform is initially applied to the comparator circuit.

11. The apparatus according to claim 10 further comprising means for disabling the current switching means until a prescribed operating voltage is supplied to the differentiator circuit and to the comparator circuit.

12. The apparatus according to claim 11 further comprising selective means for selectively supplying a comparison voltage to the comparator circuit.

13. The apparatus according to claim 12 further comprising means, connected to the current switching means and to the selective means, for detecting current flowing through the current switching means, wherein the selective means selectively supplies the comparison voltage to the comparator circuit in response to the amount of current detected.

14. A circuit for regulating the illumination of a lighting element connected to an alternating-current voltage supply comprising:

current switch means, connected to the lighting element, for allowing a current to flow through the lighting element in response to a first signal and for inhibiting current flow through the lighting element in response to a second signal; and current switch control means, connected to the current switch means, for generating the first signal and the second signal absent capacitance so that a phase of the current flowing through the lighting element leads a phase of the voltage applied to the lighting element.

15. A circuit for regulating the illumination of a lighting element connected to an alternating-current voltage supply comprising;

current switch means, connected to the lighting element, for allowing a current to flow through the lighting element in response to a first signal and for inhibiting current flow through the lighting element in response to a second signal;

current switch control means, connected to the current switch means, for generating the first signal and the second signal so that a phase of the current flowing through the lighting element leads a phase of the voltage applied to the lighting element.

the current switch control means comprising:

voltage detecting means for detecting a prescribed voltage applied to the lighting element and for generating a detected voltage signal in response thereto;

current detecting means for detecting a first prescribed current and a second prescribed current flowing through the lighting element and for generating a first detected current signal and a second detected current signal, respectively, in response thereto; and switch driving means, coupled to the voltage detecting means and to the current detecting means, for generating the first signal when the prescribed voltage and the first prescribed current is detected and for generating the second signal when the second prescribed current is detected.

16. The circuit according to claim 15 wherein the switch driving means comprises a flip-flop, the flip-flop having a clock input terminal coupled to the voltage detecting means for receiving the detected voltage signal therefrom and a data input terminal coupled to the current detecting means for receiving the first and second detected current signals therefrom.

17. The circuit according to claim 16 wherein the flip-flop transfers the first detected current signal to an output terminal thereof in response to the detected voltage signal for generating the first signal.

18. The circuit according to claim 17 wherein the switch driving means further comprises an AND gate, coupled to the current detecting means, for generating the second signal when the second prescribed current is detected.

19. The circuit according to claim 18 wherein the AND gate is coupled to the output terminal of the flip-flop for generating the first signal when the flip-flop transfers the first detected current signal to the output terminal.

20. The circuit according to claim 14 wherein the current switch means operates with electrical power from the voltage supply in the range of from approximately 110 volts RMS to 240 volts RMs and from approximately 48 Hz to 500 Hz.

* * * * *

UNITED STATES PATENT AND TRADEMARK OFFICE
CERTIFICATE OF CORRECTION

PATENT NO. : 4,893,063

DATED : January 9, 1990

INVENTOR(S) : Joseph Pernyeszi

It is certified that error appears in the above-identified patent and that said Letters Patent is hereby corrected as shown below:

The sheets of drawings consisting of Figs. 2, 4, 5, 6 and 7, should be added as shown on the attached sheet.

Signed and Sealed this

Twenty-sixth Day of February, 1991

*Attest:*

HARRY F. MANBECK, JR.

*Attesting Officer*

*Commissioner of Patents and Trademarks*